US011732537B2

(12) United States Patent
Jones et al.

(10) Patent No.: US 11,732,537 B2
(45) Date of Patent: Aug. 22, 2023

(54) ANCHOR POINT DEVICE FOR FORMATION TESTING RELATIVE MEASUREMENTS

(71) Applicant: Halliburton Energy Services, Inc., Houston, TX (US)

(72) Inventors: Christopher Michael Jones, Katy, TX (US); Darren George Gascooke, Houston, TX (US); Anthony Herman Van Zuilekom, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/489,410

(22) Filed: Sep. 29, 2021

(65) Prior Publication Data

US 2023/0103029 A1 Mar. 30, 2023

(51) Int. Cl.

| | |
|---|---|
| ***E21B 23/01*** | (2006.01) |
| ***E21B 47/01*** | (2012.01) |
| ***E21B 49/00*** | (2006.01) |
| ***E21B 47/04*** | (2012.01) |

(52) U.S. Cl.
CPC ..... *E21B 23/01* (2013.01); *E21B 47/01* (2013.01); *E21B 47/04* (2013.01); *E21B 49/00* (2013.01)

(58) Field of Classification Search
CPC ..... E21B 23/01; E21B 47/01; E21B 47/04; E21B 49/00
See application file for complete search history.

(56) References Cited

U.S. PATENT DOCUMENTS

| | | | |
|---|---|---|---|
| 5,025,861 | A | 6/1991 | Huber et al. |
| 6,241,031 | B1 | 6/2001 | Beaufort et al. |
| 6,276,532 | B1 | 8/2001 | Sperry et al. |
| 6,427,786 | B2 | 8/2002 | Beaufort et al. |
| 6,464,003 | B2 | 10/2002 | Bloom et al. |
| 6,569,283 | B1 | 5/2003 | Sperry et al. |
| 6,630,890 | B1 | 10/2003 | Endo et al. |
| 6,640,894 | B2 | 11/2003 | Bloom et al. |
| 6,715,559 | B2 | 4/2004 | Bloom et al. |
| 7,048,025 | B2 | 5/2006 | Sperry et al. |

(Continued)

OTHER PUBLICATIONS

Search Report and Written Opinion issued for International Patent Application No. PCT/US2021/052707, dated Jun. 17, 2022, 8 pages.

(Continued)

*Primary Examiner* — Caroline N Butcher
(74) *Attorney, Agent, or Firm* — John Wustenberg; C. Tumey Law Group PLLC

(57) ABSTRACT

A downhole probe can be utilized in a wellbore to accurately determine a relative depth between measurement locations. The downhole probe includes a measurement unit for taking downhole measurements and a detachable anchor that can grip a wellbore wall to maintain a fixed location. The measurement unit may be moved relative to anchor between the measurement locations to unspool a tether coupled between the anchor and the measurement unit. The length of the tether unspooled may provide a more accurate indication of the relative distance between the measurement locations than surface-based measurements. The detachable anchor may be retrieved for deployment at additional measurement locations or may be abandoned in the wellbore.

20 Claims, 7 Drawing Sheets

(56) References Cited

U.S. PATENT DOCUMENTS

| | | | | |
|---|---|---|---|---|
| 7,048,047 | B2 | 5/2006 | Bloom et al. | |
| 7,275,593 | B2 | 10/2007 | Bloom et al. | |
| 7,604,060 | B2 | 10/2009 | Bloom et al. | |
| 8,944,161 | B2 | 2/2015 | Bloom et al. | |
| 9,228,403 | B1 | 1/2016 | Bloom et al. | |
| 9,233,466 | B2 | 1/2016 | Skrinde | |
| 9,328,578 | B2 | 5/2016 | Kumaran et al. | |
| 9,476,274 | B2 | 10/2016 | Edmonstone et al. | |
| 9,617,829 | B2 | 4/2017 | Dale et al. | |
| 9,988,868 | B2 | 6/2018 | Bloom et al. | |
| 10,265,851 | B2 | 4/2019 | Skrinde | |
| 2009/0084543 | A1* | 4/2009 | Fitzgerald | E21B 23/14 166/66.4 |
| 2011/0220370 | A1 | 9/2011 | Schilte et al. | |
| 2014/0174725 | A1 | 6/2014 | Dalvi et al. | |
| 2016/0258268 | A1* | 9/2016 | Rodney | E21B 47/04 |
| 2016/0326807 | A1* | 11/2016 | Jerez | E21B 7/06 |
| 2018/0216458 | A1* | 8/2018 | Garcia | E21B 49/10 |

OTHER PUBLICATIONS

International Search Report and Written Opinion for International Patent Application No. PCT/US2021/052707 dated Jun. 17, 2022.

* cited by examiner

ANCHOR POINT DEVICE FOR FORMATION TESTING RELATIVE MEASUREMENTS

BACKGROUND

The present disclosure relates generally to subterranean tools and methods for accessing geologic formations through a wellbore. More particularly, embodiments of the disclosure include a probe that may be employed to collect downhole measurements at different locations in a wellbore and accurately determine a distance between the different locations at which the measurements were taken.

During the drilling and completion of an oil and gas wellbore, the formation is often monitored and evaluated. For example, a wireline probe may be lowered into the wellbore to determine various formation properties such as permeability, fluid type, fluid quality, formation temperature, formation pressure, fluid properties including chemical properties such as composition, physical properties including PVT properties such as bubble-point or phase envelop, or compressibility and the variation of those properties through the wellbore or across the field such as with a formation pressure gradient. To understand the geological formations being drilled and the oil or gas deposits being accessed, an absolute depth of the probe may be determined for each measurement, and the measurements may be compared to one another based on the associated absolute depths.

The absolute depth of the probe in the wellbore is typically given by a surface-based measurement of the length of the wireline, or drill pipe between the probe and the surface. However, due to various distortions, the cumulative length of the wireline within the wellbore can differ from the cumulative length measured at the surface, resulting in errors in the determination of the absolute depth. According to some estimates for wireline, for every 1000 feet of wireline measured at the surface, uncertainty of ±2 feet is associated with each absolute depth determined. Often this uncertainty is the greatest uncertainty for determining a wellbore value. For example, the density of a fluid may be determined using the hydrostatic equation ($P=\rho \cdot g \cdot h$, where P is the fluid pressure, $\rho$ the density, g is the acceleration of gravity and h is the height of the fluid above the location where measurement is made). Since the pressure (P) of the fluid may be measured very accurately with a downhole probe, the uncertainty in the absolute depth (h) may create relatively large uncertainties in the fluid gradient and derived density determined. With these large uncertainties, density changes between multiple relative depths may be difficult to detect.

BRIEF DESCRIPTION OF THE DRAWINGS

The disclosure is described in detail hereinafter, by way of example only, on the basis of examples represented in the accompanying figures, in which.

DETAILED DESCRIPTION

The present disclosure describes a downhole probe that can be utilized in a wellbore to accurately determine a relative depth between measurement locations. The downhole probe includes a measurement unit for taking downhole measurements and a detachable anchor that can grip a wellbore wall and maintain the anchor in a fixed location. The measurement unit may be moved relative to anchor between the measurement locations and a separation distance between the anchor and the measurement unit may be determined. In some embodiments, the relative movement between the anchor and the measurement unit operates to unspool or feed a tether coupled between the anchor and the measurement unit. The length of the tether unspooled may provide a more accurate indication of the relative distance between the measurement locations than surface-based measurements.

Figure 1:
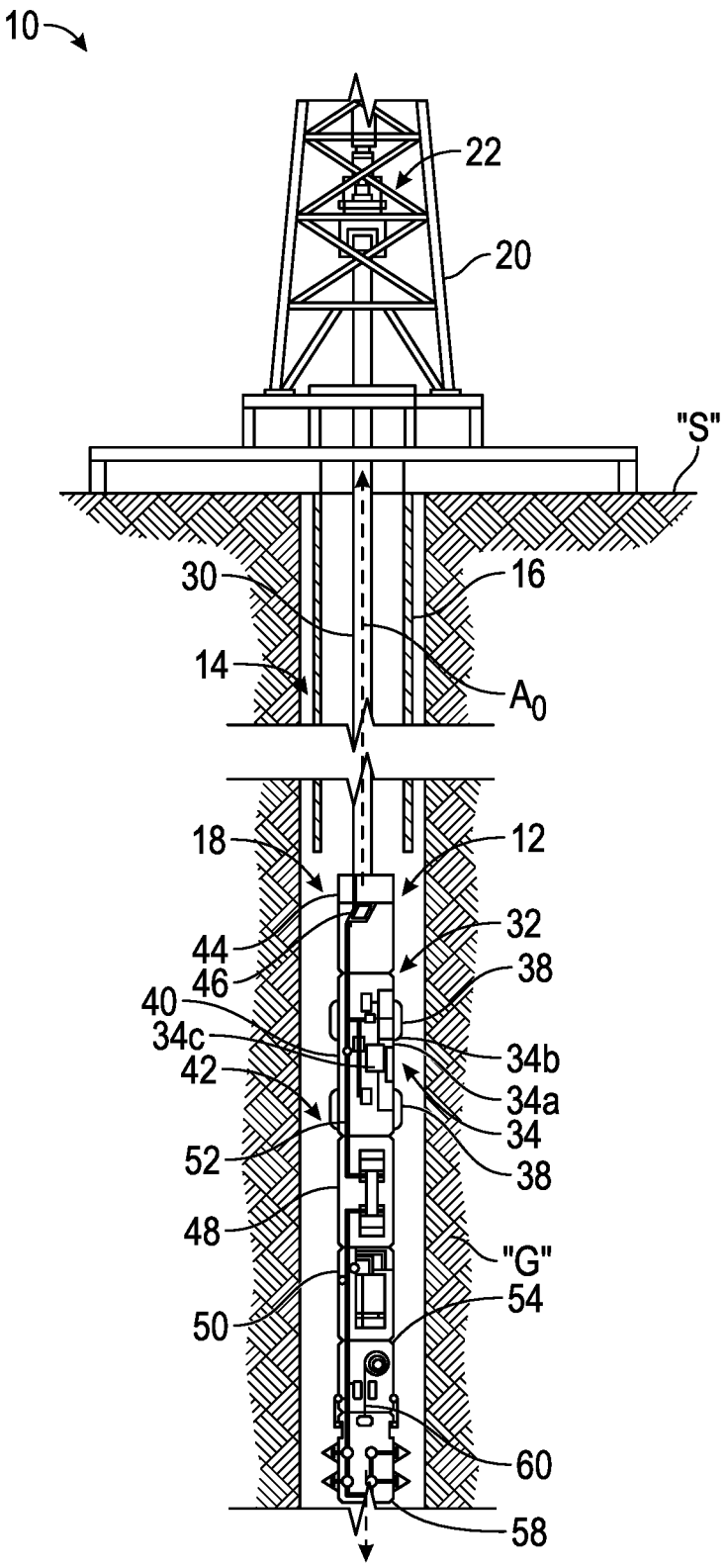
FIG. 1 is a partial, cross-sectional side view of a wellbore system illustrating a downhole probe including a detachable anchor for measuring relative depths in the wellbore in accordance with aspects of the present disclosure.

FIG. 1 illustrates a wellbore system 10 including a downhole probe 12 is deployed in a wellbore 14. The wellbore 14 extends through a geologic formation "G" from a terrestrial or land-based surface location "S." In other embodiments, a wellbore may extend from offshore or subsea surface locations (not shown) using with appropriate equipment such as offshore platforms, drill ships, semi-submersibles and drilling barges. The wellbore 14 defines an "uphole" direction referring to a portion of wellbore 14 that is closer to the surface location "S" and a "downhole" direction referring to a portion of wellbore 14 that is further from the surface location "S." Wellbore 14 is illustrated in a generally vertical orientation extending along an axis AO. In other embodiments, the wellbore 14 may include portions in alternate deviated orientations such as horizontal, slanted or curved without departing from the scope of the present disclosure. Wellbore 14 optionally includes a casing string 16 therein, which extends generally from the surface location "S" to a selected downhole depth. Casing string 16 may be constructed of distinct casing or pipe sections coupled to one another in an end-to-end configuration. Portions of the wellbore 14 that do not include casing string 16, e.g., downhole portion 18, may be described as "open hole.

Wellbore system 10 includes a derrick or rig 20 at the surface location "S." Rig 20 may include surface equipment 22, e.g., as a hoisting apparatus for raising and lowering a wireline 30 or other conveyance. Other types of conveyance include drill pipe slicklines or cables for embodiments where fluid flow to the probe assembly 12 is not required, and tubulars such as drill pipe, a work string, coiled tubing, production tubing for embodiments where fluid flow to the probe assembly 12 may be utilized. The surface equipment 22 may also include a surface measurement apparatus for measuring a length of the wireline 30 deployed into the wellbore 14. For example, a sensor for counting visual or magnetic or textural indicators provided on the wireline 30 or for counting the rotation of a pulley or drive wheel 72 (FIG. 2) coupled to the wireline may be provided.

The downhole probe 12 is coupled to a downhole end of the conveyance 30 and is illustrated within the open hole portion 18 of the wellbore 14. The downhole probe 12 generally includes measurement unit 32 illustrated with a straddle packer 34. The straddle packer 34 is operable to isolate a portion of the wellbore 14 with at least two packer elements 38 axially spaced along a mandrel 40. In some embodiments, the straddle packer 34 includes a port 34*a* disposed on the mandrel 40 between the packer elements 38, internal flow passages 34*b* in fluid communication with the port 34*a*, e.g., for collecting fluid samples from an annular space around the mandrel 40. The measurement unit 32 may include instruments 34*c* therein such as pressure sensors, temperature sensors, acoustic or ultrasonic sensors, NMR sensors, nuclear sensors including gamma ray sensors or neutron sensors, electromagnetic sensors such as resistivity, capacitance or dielectric sensors, and fluid sensors such as but not limited to physical property fluid sensors, chemical property fluid sensors, optical sensors, magnetic sensors and/or other instruments therein for collecting information about the geologic formation or fluid contained therein "G" and the downhole environment including the fluid contained in the wellbore, or fluid pulled from the formation into the wellbore. The instruments 34*c* may be in fluid communication with the port 34*a* between the packer elements 38. While the measurement unit 32 is presented herein in the context of straddle packer 34, in other embodiments (not shown) the straddle packer 34 may be replaced by an alternate isolation mechanism such as a pad, or focused sampling system, or as an extendable sampling tube that may penetrate the geologic formation "G". Various tests may be conducted downhole including but not limited to pressure, volume, temperature (PVT) tests and phase behavior tests on the fluids, or for conducting micro-fracture tests on the rock as will be recognized by those skilled in the art. Measurements may be rock type, mineralogy, permeability, porosity, mobility, wellbore images, fluid properties including fluid composition such as methane, ethane, propane, butane, pentane, hexane and higher hydrocarbons abbreviated by the number of carbons in the molecules, e.g., C1, C2, C3, C4, C5, C6, C6+, or C7+ or any combination therein up to C40, pH, CO2, mercury, compressibility, bubble point, Gas to Oil Ratio (GOR), formation volume factor, liquid fractions such as but not limited to saturates, aromatics, resins and asphaltenes, and scaling potential such as but not limited to asphaltene onset pressure.

The downhole probe 12 also includes a telemetry unit 44, a hydraulic fluid source 46, a pump 48 and one or more sample chambers 50 operably coupled to the measurement unit 32. The telemetry unit 44 may include any wired or wireless communication system for receiving instructions from the surface location "S" or other locations in the wellbore system 10 for the any control mechanisms within the downhole probe 12. A control line 52 is illustrated for communicating electric and hydraulic signals throughout the downhole probe 12. The control line 52 may be communicatively coupled to the surface location "S" through the wireline and may include any of the electrical cables, hydraulic lines or other mechanism for transmitting instructions and signals among components coupled to the control line 52.

A tether unit 54 and a detachable anchor 58 are disposed at a lower end of the downhole probe 12. Together, the tether unit 54 and the detachable anchor 58 may be employed to accurately measure a distance between locations in the wellbore 14 in which measurements are taken by the measurement unit 32. As described in greater detail below, the detachable anchor 58 may be secured to the geologic formation "G" at a first measurement location where wellbore measurements are taken by the measurement unit 32. The remainder of the downhole probe 12 may be moved upward away from the detachable anchor 58 to a second measurement location, and a length of a tether 60 deployed from the tether unit 54 may be measured to determine a relative distance between the measurement locations.

Figure 2:
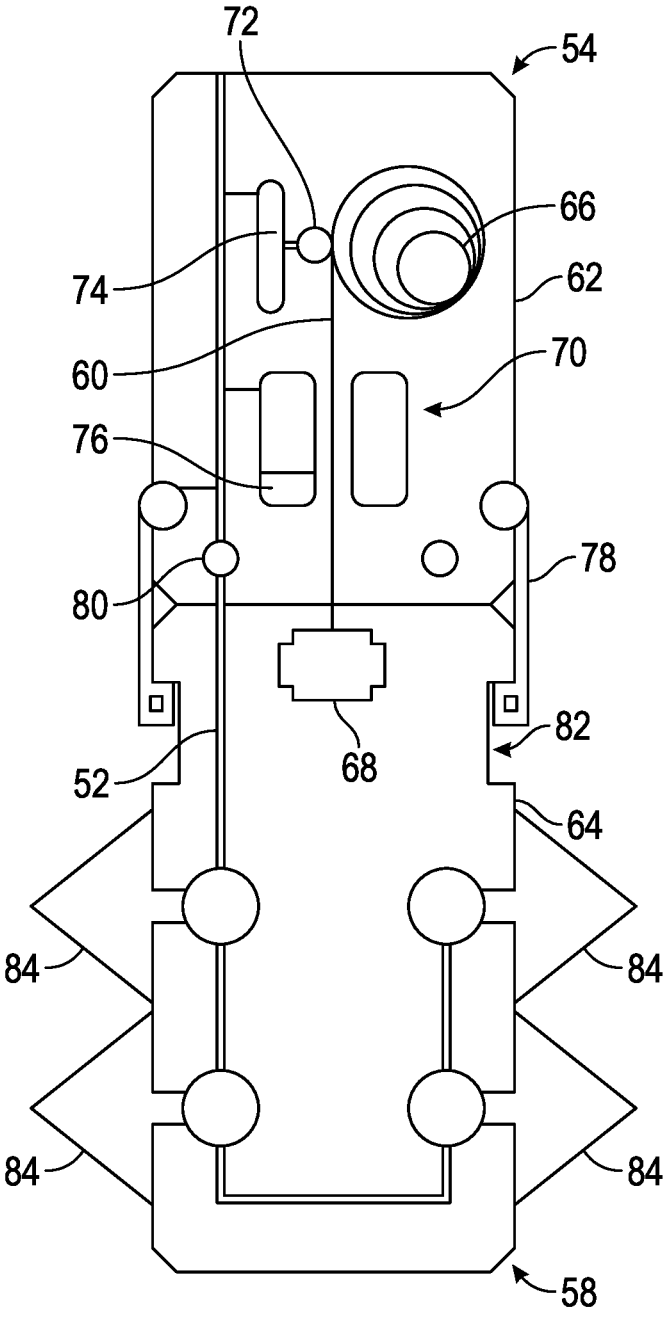
FIG. 2 is a cross-sectional side view of the detachable anchor of FIG. 1 coupled to a tether unit of the downhole probe.
Figure 3:
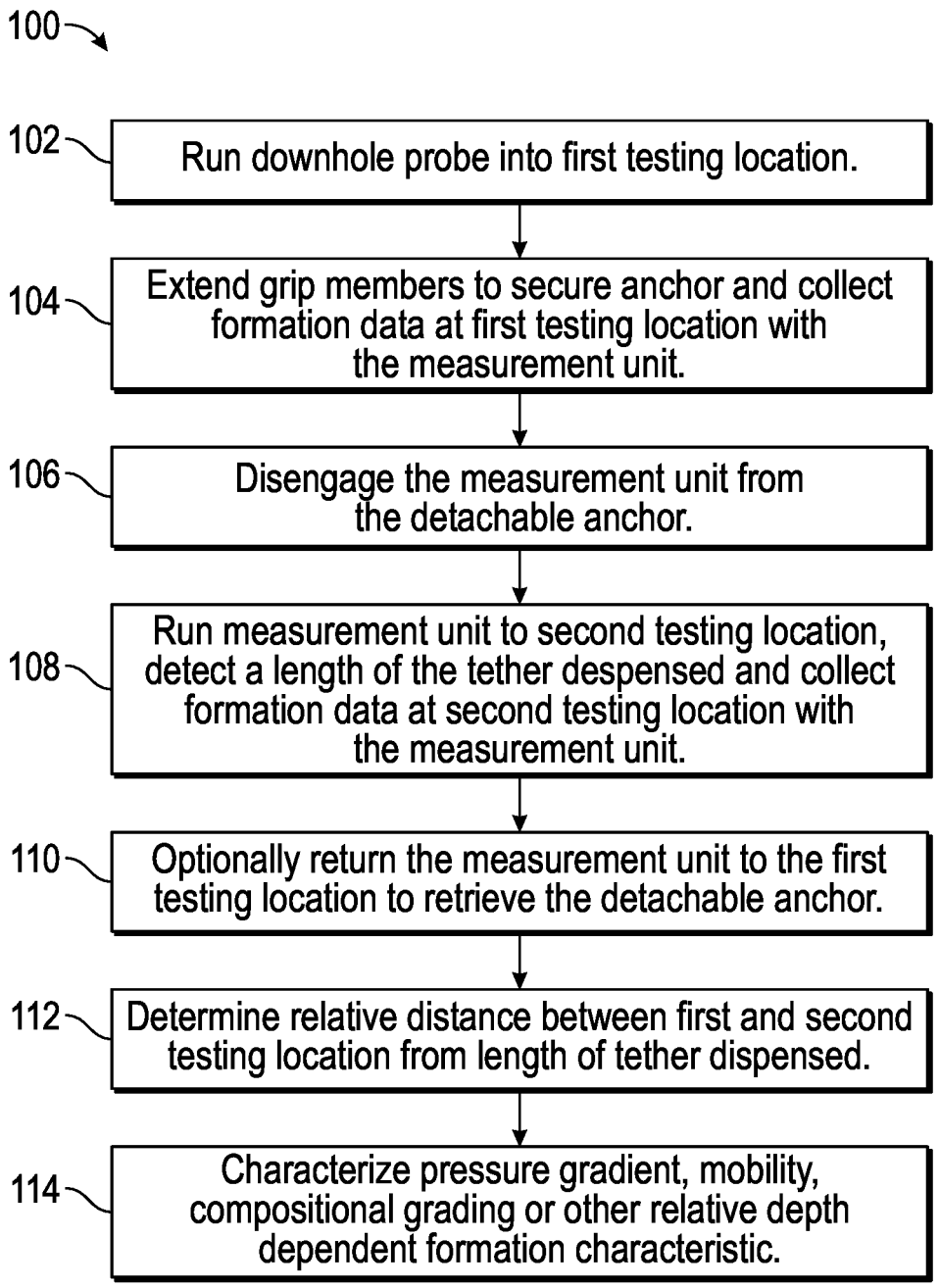
FIG. 3 is a flowchart illustrating a procedure for operating the downhole probe through the stages of operation illustrated in FIGS. 4A through 4F.

Referring to FIG. 2, the detachable anchor 58 and the tether unit 54 are illustrated together in an attached configuration with respect to one another. The tether unit 54 is illustrated with a distinct tether housing 62, which is carried by the measurement unit 32 (FIG. 1) and is illustrated adjacent an anchor housing 64 of the detachable anchor 58. In other embodiments (see, e.g., FIG. 5), one or more of the components housed within the tether housing 62 may be housed together with any of the components adjacent the detachable anchor 58. The tether 60 is wound on a spool 66 and extends to a fixture 68 on the detachable anchor 58 to which an end of the tether 60 is attached. The tether 60 may be constructed of a steel cable, thin wire or a ribbon that may readily unwind from the spool 66 or be fed by other mechanisms not shown, when the detachable anchor 58 is separated from the tether unit 54 as described below. In some embodiments, the tether 60 has an unspooled length of about 200 feet or less and has a lower stretch potential than the wireline 30 (FIG. 1) so that a length of the tether may more accurately be measured than a length of the wireline 30. In some embodiments, the spool 66 may be spring-loaded such that the tether 60 is biased to a spooled configuration.

The tether unit 54 includes a downhole detector 70 for measuring a length of the tether 60 deployed from the spool 66. The downhole detector 70 may include an optical sensor for identifying visual indicators of length provided at known intervals on the tether 60, a magnetic sensor to detect magnetic markers on the tether 60 or any type of sensor for detecting a characteristic indicative of the length of the tether 60 deployed between the tether housing 62 and the anchor housing 64. In some embodiments, the downhole detector 70 includes an encoder or rotational sensor for counting the rotations of a pulley or drive wheel 72 operatively associated with the tether 60. The downhole detector 70 may also be communicatively coupled to the drive wheel 72 through control cable 52 and a drive motor 74, which may be employed, in some embodiments, to facilitate winding or unwinding the tether 60 from the spool 66, e.g., to dislodge a stuck detachable anchor 58 or measurement unit 54. The downhole detector 70 may include a memory 76 for storing information related to the length of tether 60 unspooled, and in some embodiments, this information may be transmitted through the control cable 52 to the telemetry unity 44 (FIG. 1), the wireline 30 or another portion of the downhole probe 12.

The tether unit 54 also includes a latch 78 for selectively securing the detachable anchor 58 to the tether unit 54. As illustrated, the latch 78 includes a plurality of arms pivotally coupled to the tether housing 62 and engaging a recess 82 defined in the anchor housing 64. The latch 78 is operatively coupled to the control line 52 to receive instructions from an operator at the surface or another location on the downhole probe 12. A valve 80 is provided on the control line 52, which may be closed to prevent the flow of any hydraulic fluid to the detachable anchor 58 when the latch 78 is opened. Although illustrated as including a plurality of arms, any type of remotely operable latch is contemplated for use within the tether unit 54.

The detachable anchor 58 includes a plurality of radially extendable grip members 84 that may selectively be extended from the anchor housing 64 to engage the geologic formation "G" (FIG. 1). The grip members 84 are operatively coupled to the control line 52 and may be hydraulically actuated. As illustrated, the grip members are conical shaped spikes or friction elements that may be forced radially outward to penetrate the inner surface of a borehole, for example under the force of hydraulic fluid supplied from the hydraulic fluid source 46 by pump 48. Other types of frictional elements may be employed other embodiments including metallic pads, blocks or plates. In still other embodiments, a radially extendable grip member may include elastomeric packers that expand radially in response to axial compression, inflatable packers, sliding slips or other types of wellbore grips recognized in by those skilled in the art.

Figure 4C:
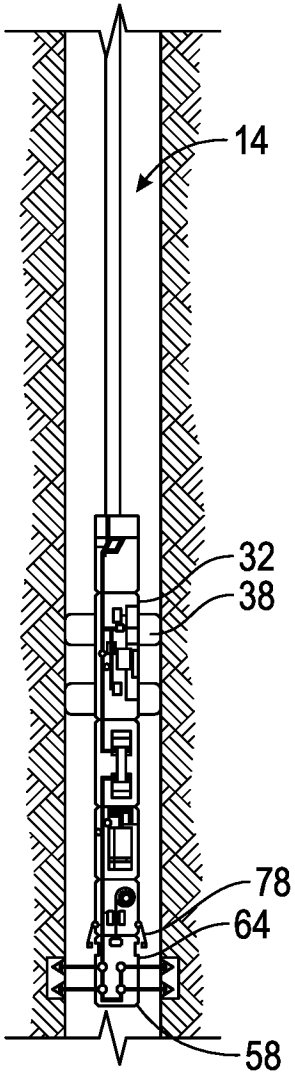
FIGS. 4A through 4F are schematic views of the downhole probe of FIG. 1 in different stages of operation for deploying the detachable anchor to determine a relative distance between measurement locations in the wellbore.
Figure 4B:
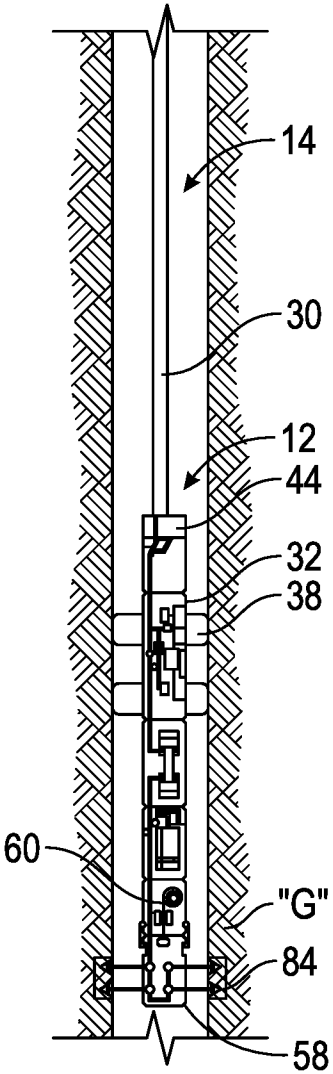
Figure 4A:
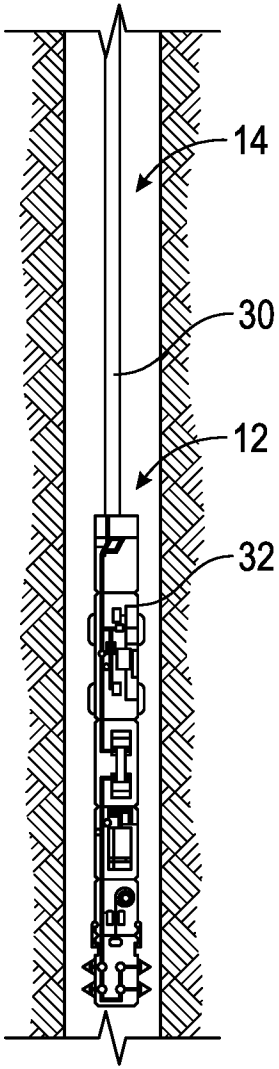

Referring now to FIG. 3 and FIGS. 4A through 4F, a procedure 100 for operating the downhole probe 12 through various stages of operation is illustrated. Initially at step 102, the downhole probe 12 is run into the wellbore 14 until the measurement unit 32 is located at a first testing location (FIG. 4A). The first testing location may be identified, for example, by monitoring a length of the wireline 30 or other conveyance deployed into the wellbore 14.

Next, at step 104, the grip members 84 are extended to engage the geologic formation "G" and fix the location of the detachable anchor 58 in the wellbore 14. The packer elements 38 may be extended form the measurement unit 32, as illustrated in FIG. 4B, and the measurement unit 32 may be employed to make a first set of measurements and collect formation data and/or samples at the first testing location. The first set of measurements may be transmitted through the wireline 30 or otherwise to the surface location "S" (FIG. 1) with the telemetry unit 44. Alternatively, the first set of measurements may be stored in a memory, e.g., memory 76 (FIG. 2) for retrieval upon removal of the downhole probe 12 from the wellbore 14. The first set of measurements may be transmitted or stored with an indication of the length of the tether 60 unspooled. For example, the length of the tether 60 unspooled at the first testing location may be zero.

At step 106, the detachable anchor 58 may be disengaged from the measurement unit 32. For example, instructions may be delivered to the latch 78 to disengage the anchor housing 64 as indicated in FIG. 4C. If necessary, the packer elements 38 may be disengaged form the geologic formation "G" around the wellbore 14 to prepare the measurement unit 32 to be moved to a second testing location.

Figure 4F:
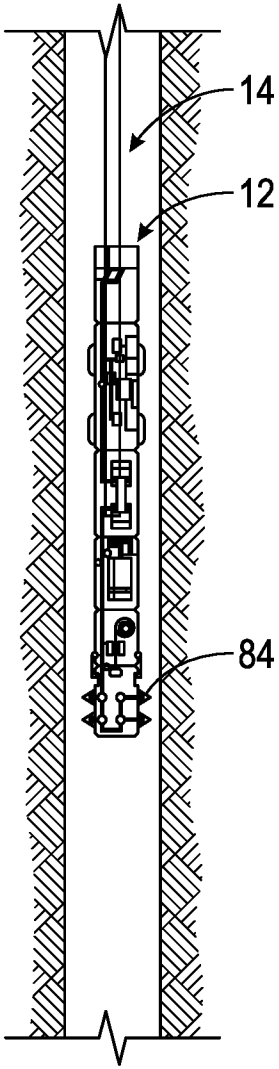
Figure 4E:
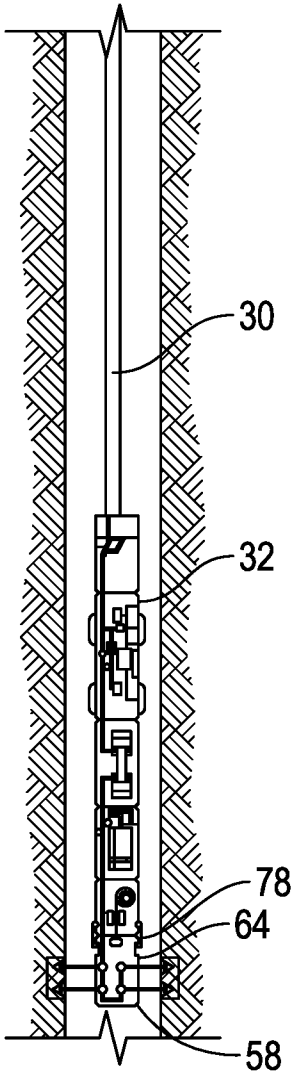
Figure 4D:
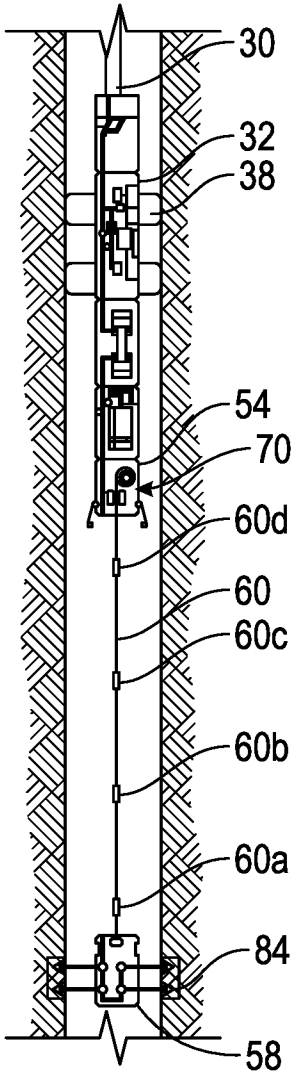

Next, at step 108, the measurement unit 32 may be conveyed to a second testing location with the wireline 30. Since the grip members 84 are extended, the detachable anchor 58 remains in place in the wellbore 14, and a length of the tether 60 is dispensed from the tether unit 54 as indicated in FIG. 4D. The length of the tether 60 unspooled or dispensed is monitored. For example, visual or magnetic markers 60*a-d* provided at regular or predetermined intervals along a length of the tether 60 may be detected by an optical or magnetic sensor included in the downhole detector 70. The length of tether 60 unspooled, dispensed or otherwise deployed between the anchor 58 and the measurement unit 32 may transmitted to the surface location "S" (FIG. 1) or be stored memory 76 (FIG. 2). The packer elements 38 may again be extended, and the measurement unit 32 may be employed to make a second set of measurements and collect formation data and/or samples at the second testing location. The second set of measurements may be transmitted or stored with an indication of the length of the tether 60 unspooled.

At step 110, the measurement unit 32 may optionally be returned to the first measurement location with the wireline 30 to retrieve the detachable anchor 58. The latch 78 may be instructed to reengage the anchor housing 64 as illustrated in FIG. 4E. Next, the grip members 84 may be retracted and the entire downhole probe 12 may again be conveyed to the surface location "S" (FIG. 1) or another location in the wellbore 14 as illustrated in FIG. 4F.

Next, at step 112, a relative distance between the first and second testing locations may be determined using the length of tether 60 dispensed, stored or transmitted in step 108. Where the wellbore 14 is vertical, as illustrated in FIG. 4D, the length of tether 60 dispensed may be directly indicative of the relative distance between the first and second testing locations. In other embodiments, corrections may be made for any nonuniformity, such as a curvature in the wellbore 14, and any known stretching caused by measurable tension in the tether 60. At step 114, the relative distance between the first and second testing locations may be used to characterize pressure gradient, mobility, compositional grading or other relative depth dependent formation characteristic.

The procedure 100 has been described such that the first testing location is adjacent stationary location of the detachable anchor 58 and the second testing location up hole of the first testing location. In other embodiments, the first and second testing locations may be reversed. The packer elements 38 may be engaged to secure location of the measurement unit 32 in the wellbore 14. The detachable anchor 58 may then be lowered from the measurement unit 32, for example, with the drive motor 74 (FIG. 2) or by gravity alone. Once the detachable anchor 58 reaches an appropriate location and an appropriate length of the tether 60 is unspooled, the grip members 84 may be extended fix the location of the detachable anchor 58. A source of hydraulic fluid and a pump (not shown) could be housed within the detachable anchor 58 to extend the grip members 84. After a first set of measurements is collected with packer elements 38 engaged, the measurement unit 32 could be conveyed downhole toward the stationary location of the detachable anchor 58. A second set of measurements may then be collected once the detachable anchor 58 is reached. Additional measurements may be collected between the first and second measurement locations, and for each set of measurements, a length of the tether 60 respooled may be noted and correlated with the set of measurements.

Such a modified procedure may simplify operations since it may not be necessary to reverse the direction of the measurement unit 32 to retrieve the detachable anchor. In other embodiments, described in greater detail below, one or more detachable anchors may be intentionally abandoned in the wellbore, which may also simplify operation.

Figure 5:
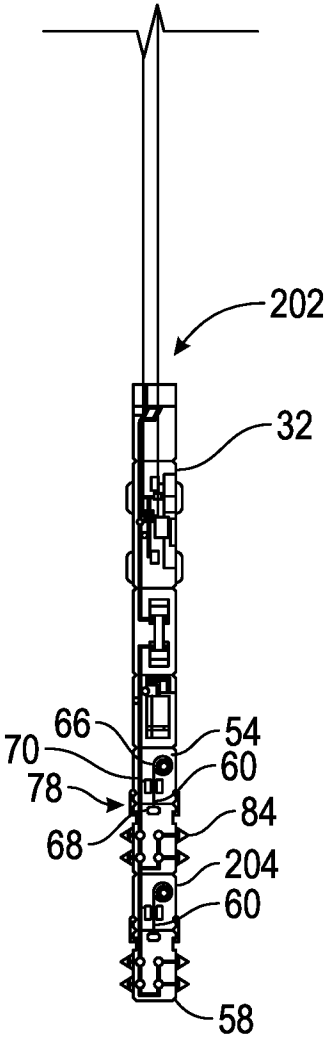
FIG. 5 is a cross-sectional side view of an alternate downhole probe including a plurality of detachable anchors that may be deployed in series from a lower end of the downhole probe.

Referring now to FIG. 5, an alternate embodiment of a downhole probe 202 includes a plurality of detachable anchors 58, 204 that may be deployed in series from a lower end of the downhole probe 202. The first detachable anchor 58 may be arranged and operated in the manner of the detachable anchor 58 of the downhole probe 12 described above. The second detachable anchor 204 is coupled between the detachable anchor 58 and the tether unit 54, and generally includes the components of both the detachable anchor 58 and the tether unit 54. Specifically, like detachable anchor 58, the detachable anchor 204 includes extendable grip members 84 and a fixture 68 to which an end a tether 60 is fastened. Like the tether unit 54, the detachable anchor 204 includes spool 66 about which a tether 60 is wound, a downhole detector 70 and a latch 78.

In operation, the downhole probe 202 may be operated to first detach the first detachable anchor 58 and unspool a first tether 60 from the second detachable anchor 204 by conveying the measurement unit 32 up hole. Next, the second detachable anchor 204 may be detached and the measurement unit 32 may again be conveyed up hole to unspool a second tether 60 from the tether unit 54. The length of both tethers 60 that is unspooled may be used to determine a relative distance between measurement locations that are greater than the length of a single tether, for example.

Figure 6:
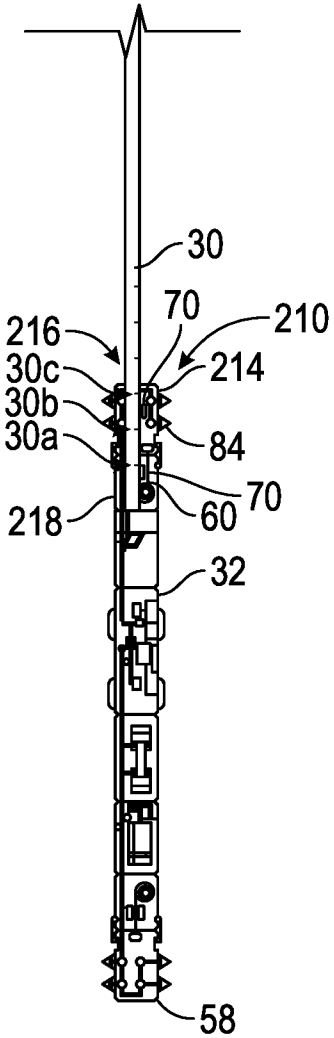
FIG. 6 is a cross-sectional side view of an alternate downhole probe including detachable anchors deployable from both upper and lower ends of the downhole probe.

Referring now to FIG. 6, an alternate embodiment of a downhole probe 210 includes a first detachable anchor 58 deployable from a lower end of the downhole probe 210 and a second detachable anchor 214 deployable from an upper end of the downhole probe 210. The first detachable anchor 58 may be arranged and operated in the manner of the detachable anchor 58 of the downhole probe 12 described above. The second deployable anchor 214 is arranged with a central opening 216 to permit the second deployable anchor 214 to slide along the wireline 30 or other conveyance. Grip members 84 may be extended to fix the location of the second deployable anchor 214, and then, the measurement unit 32 may be conveyed downhole to unspool a tether 60 from a tether unit 218. A downhole detector 70 carried by the tether unit 218 may be employed to determine a length of the tether 60 unspooled to determine a separation distance between the second detachable anchor 214 and the tether unit 218. Additionally or alternatively, a downhole detector 70 carried by the second detachable anchor 214 may be provided for identifying visual or magnetic markers 30*a-d* provided on the wireline or conveyance for determining a separation distance between the second detachable anchor 214 and the tether unit 218. The deployable anchor 214 and/or the tether unit 218 may be inductively coupled to the wireline 30 such that an indication of the length of the tether 60 unspooled may be transmitted between the second detachable anchor 214 and the tether unit 218, to an operator at the surface location "S" (FIG. 1) or to another location through the wireline 30. Alternatively, the length of the tether 60 deployed may be stored in a memory for retrieval upon removal of the downhole probe 210 from the wellbore.

Figure 7:
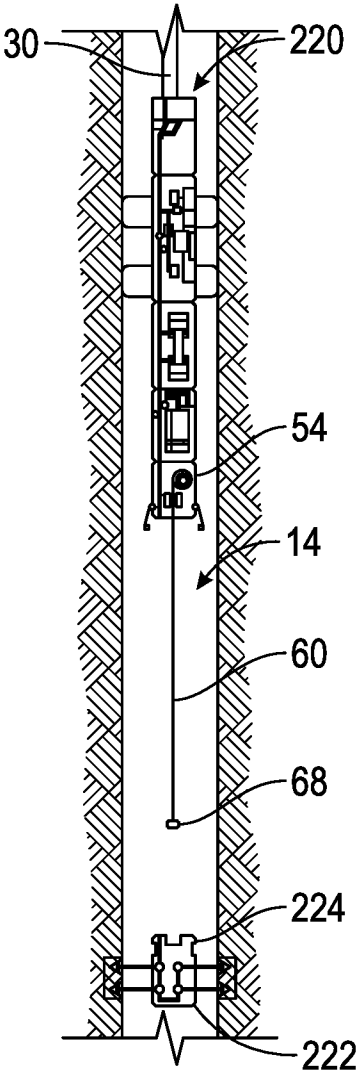
FIG. 7 is a cross-sectional side view of an alternate downhole probe including a detachable anchor that may be untethered for intentional abandonment in the wellbore.

As illustrated in FIG. 7, a downhole probe 220 is arranged with a detachable anchor 222 that may be intentionally abandoned in the wellbore 14. As illustrated, the detachable anchor 222 is constructed with a frangible housing 224 that may permit the fixture 68 to be severed or removed from the housing 224 by supplying a sufficient tension on the tether 60. The tension may be supplied, for example, by activating drive motor 74 (FIG. 2) in the tether unit 54, or by raising the wireline 30. In other embodiments, the tether 60 may be cut by a blade (not shown) carried by the detachable anchor 222 or the tether unit 54.

The frangible housing 224 may be constructed of a material such as plastic, rubber or a brittle ceramic that will not interfere with the operation of a drill bit (not shown). Thus, drilling operations may be conducted after measurements are collected with the measurement unit 32 and the downhole probe 220 is removed from the wellbore 14. The intentionally abandoned detachable anchor 222 may be readily fragmented by the drill bit. In some embodiments, a plurality of detachable anchors 222 may be deployed and abandoned in series, e.g., in a manner similar to the arrangement described above with reference to FIG. 5. This will allow a length of tether unspooled to be associated with each of a plurality of measurements, without requiring retrieval of the detachable anchors 222. Each of the intentionally abandoned detachable anchors 222 may then be drilled out of the wellbore 14 in subsequent drilling operations.

Figure 8:
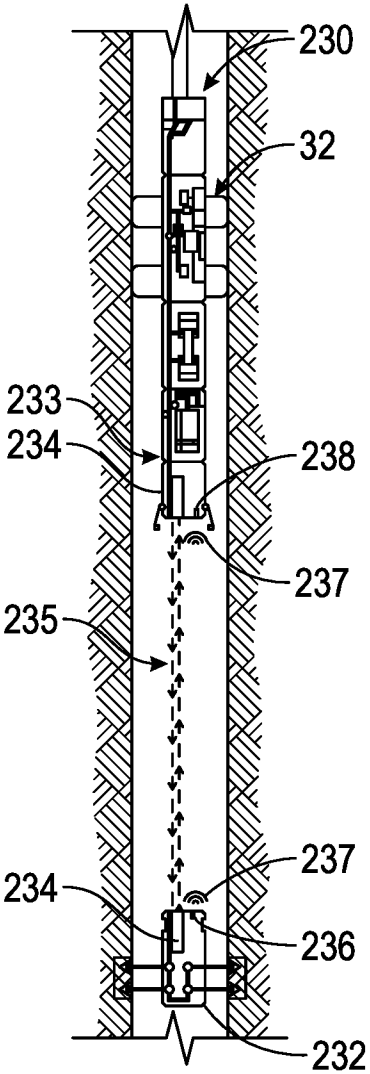
FIG. 8 is a cross-sectional side view of an alternate downhole probe including a rangefinder and a transmitter within a detachable anchor for locally relaying depth measurements within the wellbore.

Referring to FIG. 8, a downhole probe 230 includes a detachable anchor 232 selectively separable from the measurement unit 32. A downhole detector includes a rangefinder 233 for measuring a separation distance between the measurement unit 32 and the detachable anchor 232. The range finder 233 may include a telemeter 234 on one or both of the measurement unit 32 and the detachable anchor 232 for sending and receiving a pulse 235. The pulse 235 may include a laser, a sonic pulse or another type of downhole pulse reflected off the measurement unit 32 or detachable anchor 232 and returned to the telemeter 234. A separation distance between the measurement unit 32 and the detachable anchor 232 may be determined, for example, measuring the time taken by the pulse 235 to be reflected and returned to the telemeter 234 or by measuring an energy of the pulse after traveling between the measurement unit 32 and the detachable anchor 232.

The detachable anchor 232 is provided with a transmitter 236 for locally relaying depth measurements within the wellbore 14. As illustrated, the detachable anchor 232 includes extendable grip members 84 and a telemeter 234 communicatively coupled to the transmitter 236. A measurement indicative of the separation distance between the measurement unit 32 and the detachable anchor may be detected by the telemeter 234 and communicated to the transmitter 234 within the detachable anchor 232. The transmitter 234 may transmit a signal 237 indicative of the measurement or separation distance to a receiver 238 carried by another component of the downhole probe 230. The signal 237 may be a wireless electromagnetic signal, a pressure pulse imparted to a drilling fluid in the wellbore 14, an electric signal transmitted through a wellbore fluid or another type of signal recognized in the art.

Figure 9:
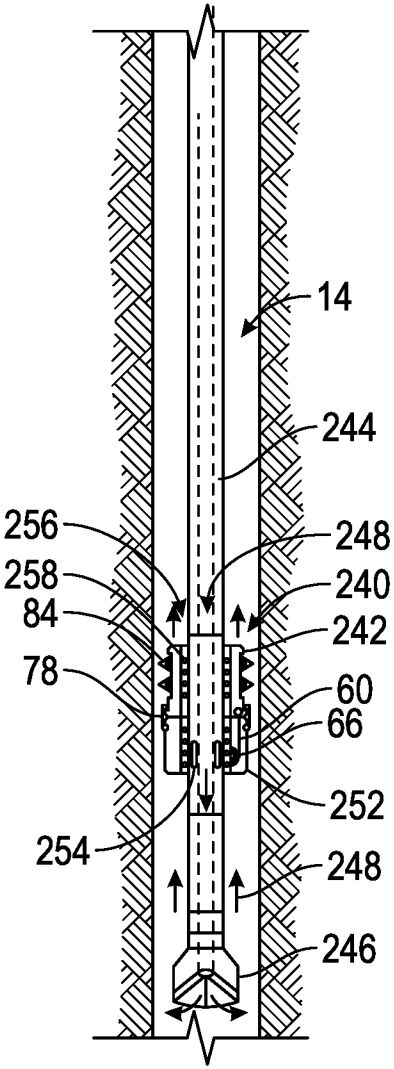
FIG. 9 is a cross-sectional side view of an alternate downhole probe including a detachable anchor arranged for deployment from a drill string.

Referring to FIG. 9, a downhole probe 240 includes a detachable anchor 242 arranged for deployment from a drill string 244. The drill string 244 carries a drill bit 246 and circulates drilling fluid 248 through the wellbore 14. A tether unit 252 carried by the drill string 242 includes a spool 66 and a downhole detector 70 (see, e.g., FIG. 8) for measuring a length of tether 60 unspooled. The tether unit 252 also carries a latch 78 for selectively securing the detachable anchor 242 to the tether unit 252. In operation, grip members 84 may be extended to secure the location of the detachable anchor 242, and the latch 78 may be operated to release the detachable anchor 242. The drill string 244 may then be advanced downhole to unspool the tether 60 from the spool 66. A length of the tether 60 unspooled may be transmitted to a logging while drilling (LWD) or measurement while drilling (MWD) system 254 carried by the drill string 244. The length of tether 60 unspooled may be correlated with measurements taken by the MWD system 254 so that depth dependent characteristics may be evaluated. As illustrated, a central opening 256 extends through both the detachable anchor 242 and the tether unit 252, and bearings 258 are provided to permit the drill string 244 to rotate within the detachable anchor 242 and the tether unit 252.

Figure 10:
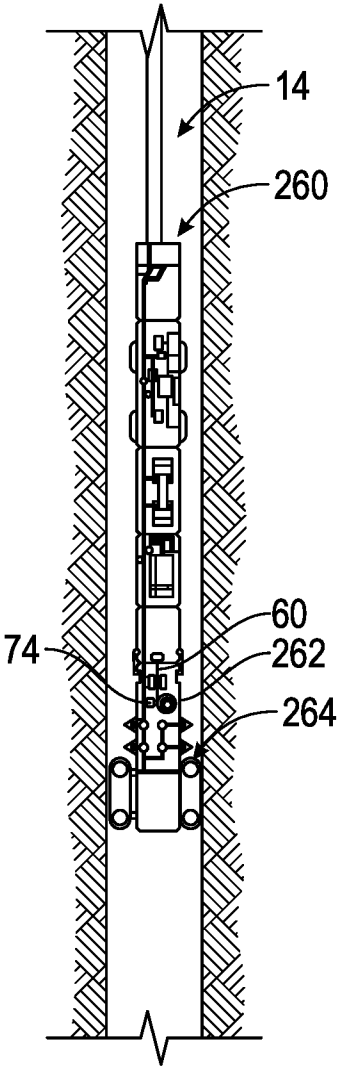
FIG. 10 is a cross-sectional side view of an alternate downhole probe including a detachable anchor with a tractor which may facilitate deploying the detachable anchor in a horizontal portion of the wellbore.

Referring to FIG. 10, a downhole probe 260 includes a detachable anchor 262 with a tractor 264. The tractor 264 includes treads 266 that may be operated carry the entire downhole probe 260 along the wellbore 14 or to carry the detachable anchor 262 away from a measurement unit 32 of the downhole probe. The tractor 264 may facilitate deploying the downhole probe 260 and detachable anchor 262 an in or through horizontal portions of the wellbore 14. The tractor 264 and/or the drive motor 74 operatively coupled to the tether 60 may be operated to dislodge the downhole probe in the event the downhole probe becomes stuck in the wellbore 14.

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter.

According to a first aspect, the disclosure is directed to a method for determining a depth-dependent characteristic of a wellbore, geologic formation or a formation fluid. The method includes (a) conveying a measurement unit to a first measurement location in the wellbore extending through the geologic formation, (b) collecting a first set of measurements about at least one of the geologic formation, the formation fluid and the wellbore with the measurement unit at the first measurement location, (c) releasing an anchor from the measurement unit, (d) securing the anchor in the wellbore, (e) separating the measurement unit from the anchor in the wellbore by conveying the measurement from the first measurement location to a second measurement location in the wellbore, (f) detecting a separation distance between the anchor and the measurement unit, (g) collecting a second set of measurements about at least one of the geologic formation, the formation fluid and the wellbore with the measurement unit at the second measurement location (h) determining a relative depth of the second measurement location with respect to the first measurement location with the separation distance detected and (i) characterizing the depth-dependent characteristic using the first and second sets of measurements and the relative depth determined.

In one or more embodiments, the method further includes deploying a tether between the anchor and the measurement unit in response to separating the measurement unit from the anchor and detecting the separation distance includes detecting a length of the tether deployed. Releasing the anchor may include operating a latch to disengage either an anchor housing of the anchor or a tether housing carried by the measurement unit. In some embodiments, the method further includes retrieving the anchor by approximating the measurement unit with the anchor and operating the latch to reengage the anchor housing or the tether housing subsequent to detecting the length of the tether deployed between the anchor and the measurement unit.

In some embodiments, detecting the length of the tether deployed may include identifying markers provided at predetermined intervals along the tether. In some embodiments, the method includes severing the tether from the anchor in the wellbore subsequent to detecting the length of the tether deployed between the anchor and the measurement unit.

In one or more embodiments, the securing the anchor in the wellbore includes radially extending a grip member from a housing of the anchor to engage the geologic formation. Radially extending the grip member may include applying pressure from a hydraulic fluid the grip member and further comprising penetrating the geologic formation with the grip member.

In some embodiments, the method further includes transmitting a signal between the anchor and the measurement unit in the wellbore subsequent to separating the measurement unit from the anchor, the signal indicative of the separation distance detected. In some embodiments, characterizing the depth-dependent characteristic includes characterizing at least one of a pressure gradient, a fluid mobility in the geologic formation or a compositional grading of the geologic formation.

According to another aspect, the disclosure is directed to a downhole probe apparatus. The downhole probe apparatus includes (a) a measurement unit deployable into a wellbore extending through a geologic formation, the measurement unit including at least one instrument operable for collecting information about at least one of the geologic formation and the wellbore, (b) an anchor housing coupled to the measurement unit, (c) a latch coupled between the measurement unit and the anchor housing, the latch selectively operable to release the anchor housing from the measurement unit, (d) at least one grip member radially extendable from the anchor housing to secure the anchor housing in the wellbore and (e) a downhole detector operable to measure a separation distance between the tether housing and the anchor housing.

In one or more embodiments, the downhole probe apparatus further includes a tether coupled between anchor housing and a tether housing carried by the measurement unit, the tether deployable between the anchor housing and the tether housing in response to separation of the tether housing from the anchor housing, and wherein the downhole detector is operatively coupled to the tether to measure a length of the tether deployed between the tether housing. In some embodiments, the tether includes markers at predetermined intervals along a length of the tether, and wherein the downhole measurement detector includes one an optical or magnetic detector operable to identify the markers. The downhole probe apparatus may further include a drive wheel operably coupled to the tether, the drive wheel selectively operable for winding or unwinding the tether from a spool.

In some embodiments, the at least one instrument may include at least one of the group consisting of pressure sensors, temperature sensors and magnetic sensors. In some embodiments, the grip member includes at least one of grip member includes at least one of the group consisting of spikes, pads, blocks, plates elastomeric packers, inflatable packers and sliding slips.

In another aspect, the disclosure is directed to a downhole probe system. The downhole probe system includes (a) a conveyance deployable into a wellbore extending through a geologic formation, (b) a measurement unit coupled to the conveyance, the measurement unit including at least one instrument operable for collecting information about at least one of the geologic formation and the wellbore, (c) a detachable anchor coupled to the measurement unit, (d) a latch coupled between the measurement unit and the detachable anchor, the latch selectively operable to detach the detachable anchor from the measurement unit, (e) at least one grip member radially extendable from the anchor to secure the detachable anchor in the wellbore and (f) a downhole detector operable to measure a separation distance between the detachable anchor and the measurement unit.

In one or more embodiments, the conveyance comprises at least one of the group consisting of a wireline, a slickline and a cable. In some embodiments, the conveyance comprises drill pipe rotatable within the detachable anchor. In some embodiments, the detachable anchor includes a tractor with treads selectively operable to carry to detachable anchor along the wellbore.

The Abstract of the disclosure is solely for providing the United States Patent and Trademark Office and the public at large with a way by which to determine quickly from a cursory reading the nature and gist of technical disclosure, and it represents solely one or more examples.

While various examples have been illustrated in detail, the disclosure is not limited to the examples shown. Modifications and adaptations of the above examples may occur to those skilled in the art. Such modifications and adaptations are in the scope of the disclosure.

What is claimed is:

1. A method for determining a depth-dependent characteristic of a wellbore, geologic formation or a formation fluid, the method comprising:

conveying a measurement unit with a wireline to a first measurement location in the wellbore extending through the geologic formation;

collecting a first set of measurements about at least one of the geologic formation, the formation fluid and the wellbore with the measurement unit at the first measurement location;

releasing an anchor from the measurement unit;

securing the anchor at a subterranean location in the wellbore below the measurement unit;

separating the measurement unit from the anchor in the wellbore by conveying the measurement unit up from the first measurement location to a second measurement location in the wellbore;

detecting a separation distance between the anchor and the measurement unit with at least a length of a tether, wherein the tether is not the wireline;

collecting a second set of measurements about at least one of the geologic formation, the formation fluid and the wellbore with the measurement unit at the second measurement location;

determining a relative depth of the second measurement location with respect to the first measurement location with the separation distance detected, and characterizing the depth-dependent characteristic using the first and second sets of measurements and the relative depth determined.

2. The method of claim 1, further comprising deploying the tether between the anchor and the measurement unit in response to separating the measurement unit from the anchor, and wherein detecting the separation distance includes detecting a length of the tether deployed.

3. The method of claim 2, wherein releasing the anchor includes operating a latch to disengage either an anchor housing of the anchor or a tether housing carried by the measurement unit.

4. The method of claim 3, further comprising retrieving the anchor by operating the latch to reengage the anchor housing or the tether housing subsequent to detecting the length of the tether deployed between the anchor and the measurement unit.

5. The method of claim 2, wherein detecting the length of the tether deployed comprises identifying markers provided at predetermined intervals along the tether.

6. The method of claim 2, further comprising severing the tether from the anchor in the wellbore subsequent to detecting the length of the tether deployed between the anchor and the measurement unit.

7. The method of claim 1, wherein securing the anchor in the wellbore includes radially extending a grip member from a housing of the anchor to engage the geologic formation.

8. The method of claim 7, wherein radially extending the grip member includes applying pressure from a hydraulic fluid to the grip member and further comprising penetrating the geologic formation with the grip member.

9. The method of claim 1, further comprising transmitting a signal between the anchor and the measurement unit in the wellbore subsequent to separating the measurement unit from the anchor, the signal indicative of the separation distance detected.

10. The downhole probe of claim 1, wherein characterizing the depth-dependent characteristic includes characterizing at least one of a pressure gradient, a fluid mobility in the geologic formation or a compositional grading of the geologic formation.

11. A downhole probe apparatus, comprising:

a measurement unit deployable with a wireline into a wellbore extending through a geologic formation, the measurement unit including at least one instrument operable for collecting information about at least one of the geologic formation and the wellbore;

an anchor housing coupled to the measurement unit;

a latch coupled between the measurement unit and the anchor housing, the latch selectively operable to release the anchor housing from the measurement unit;

at least one grip member radially extendable from the anchor housing to secure the anchor housing at a location in the wellbore below the measurement unit; and a downhole detector operable to measure a separation distance between a tether housing and the anchor housing with at least a length of a tether, wherein the tether is not the wireline.

12. The down hole probe apparatus of claim 11, further comprising the tether coupled between anchor housing and a tether housing carried by the measurement unit, the tether deployable between the anchor housing and the tether housing in response to separation of the tether housing from the anchor housing, and wherein the down hole detector is operatively coupled to the tether to measure a length of the tether deployed between the tether housing.

13. The downhole probe apparatus of claim 12, wherein the tether includes markers at predetermined intervals along a length of the tether, and wherein the downhole measurement detector includes one an optical or magnetic detector operable to identify the markers.

14. The downhole probe apparatus of claim 12, further comprising a drive wheel operably coupled to the tether, the drive wheel selectively operable for winding or unwinding the tether from a spool.

15. The downhole probe apparatus of claim 11, wherein the at least one instrument includes at least one of the group consisting of pressure sensors, temperature sensors and magnetic sensors.

16. The downhole probe apparatus of claim 11, wherein the grip member includes at least one of the group consisting of spikes, pads, blocks, plates elastomeric packers, inflatable packers and sliding slips.

17. A downhole probe system, comprising:

a conveyance deployable into a wellbore extending through a geologic formation;

a measurement unit coupled to the conveyance, the measurement unit including at least one instrument operable for collecting information about at least one of the geologic formation and the wellbore;

a detachable anchor coupled to the measurement unit;

a latch coupled between the measurement unit and the detachable anchor, the latch selectively operable to detach the detachable anchor from the measurement unit;

at least one grip member radially extendable from the anchor to secure the detachable anchor at a location in the wellbore below the measurement unit; and a downhole detector operable to measure a separation distance between the detachable anchor and the measurement unit with at least a length of a tether, wherein the tether is not the wireline.

18. The downhole probe system of claim 17, wherein the conveyance comprises at least one of the group consisting of a wireline, a slickline and a cable.

19. The downhole probe system of claim 17, wherein the conveyance comprises drill pipe rotatable within the detachable anchor.

20. The downhole probe system of claim 17, wherein the detachable anchor includes a tractor with treads selectively operable to carry to detachable anchor along the wellbore.

* * * * *